US006382535B1

(12) United States Patent
Kime

(10) Patent No.: US 6,382,535 B1
(45) Date of Patent: May 7, 2002

(54) MAINTENANCE VEHICLE WITH SNOW-ICE CONTROL INTEGRATED WITH A DUMP BED TAILGATE

(76) Inventor: James A. Kime, 3987 Riverview Dr., Columbus, OH (US) 43221

( * ) Notice: Subject to any disclaimer, the term of this patent is extended or adjusted under 35 U.S.C. 154(b) by 0 days.

(21) Appl. No.: 09/693,661

(22) Filed: Oct. 20, 2000

(51) Int. Cl.[7] ..... A01C 3/06

(52) U.S. Cl. ..... 239/657; 239/651; 239/663; 239/681

(58) Field of Search ..... 239/650, 651, 239/657, 662, 663, 665, 668, 681, 687, 172, 289

(56) References Cited

U.S. PATENT DOCUMENTS

| | | | | | |
|---|---|---|---|---|---|
| 2,003,628 | A | * | 6/1935 | Chadwick | 239/657 |
| 2,187,448 | A | * | 1/1940 | Currivan et al. | 239/684 |
| 2,474,065 | A | * | 6/1949 | Porter | 222/310 |
| 2,698,184 | A | * | 12/1954 | Bowen | 239/657 |
| 2,967,056 | A | * | 1/1961 | D'Amato | 111/76 |
| 3,018,908 | A | * | 1/1962 | Wilton et al. | 239/657 |
| 3,160,964 | A | * | 12/1964 | Boyer et al. | 239/657 |
| 3,189,355 | A | * | 6/1965 | Swenson et al. | 239/657 |
| 3,379,372 | A | * | 4/1968 | Nemmaier et al. | 239/142 |
| 3,583,645 | A | * | 6/1971 | Murray et al. | 239/657 |
| 4,022,386 | A | * | 5/1977 | Caye | 239/657 |
| 4,723,817 | A | * | 2/1988 | Wallan | 239/657 |
| 4,886,214 | A | * | 12/1989 | Musso et al. | 222/166 |
| RE33,835 | E | * | 3/1992 | Kime et al. | 180/53.4 |
| 5,310,119 | A | * | 5/1994 | Musso et al. | 239/657 |
| 5,318,226 | A | * | 6/1994 | Kime et al. | 239/1 |
| 5,400,974 | A | * | 3/1995 | Musso et al. | 239/657 |
| 5,466,112 | A | * | 11/1995 | Feller | 239/657 |
| 5,618,002 | A | * | 4/1997 | Cervelli et al. | 239/657 |
| 5,772,389 | A | * | 6/1998 | Feller | 239/657 |
| 5,927,617 | A | * | 7/1999 | Musso et al. | 239/657 |
| 5,931,393 | A | * | 8/1999 | Alsip et al. | 239/654 |
| 5,988,535 | A | * | 11/1999 | Kime | 239/172 |

* cited by examiner

*Primary Examiner*—Lesley D. Morris
*Assistant Examiner*—Christopher S. Kim
(74) *Attorney, Agent, or Firm*—Mueller and Smith, LPA

(57) ABSTRACT

A dump bed highway maintenance vehicle is provided with a removable tailgate which is formed of a tailgate frame having a pivotal connection with the truck dump bed which is spaced rearwardly from a normal pivot connection and contains a brine tank assemblage extending through the frame above a cross-bed auger. By so extending the brine tank assemblage through the frame, the center of gravity of the pivot mounted tailgate resides in a vertical plane extending through the outwardly displaced frame pivot mechanism. The forward wall of the brine tank assemblage is slanted forwardly upwardly to define a cross section resembling an inverted truncated right triangle.

22 Claims, 7 Drawing Sheets

MAINTENANCE VEHICLE WITH SNOW-ICE CONTROL INTEGRATED WITH A DUMP BED TAILGATE

CROSS-REFERENCE TO RELATED APPLICATIONS

STATEMENT REGARDING FEDERALLY SPONSORED RESEARCH

Not applicable.

BACKGROUND OF THE INVENTION

Highway snow and ice control frequently is carried out by governmental authorities with the use of dump trucks, which are seasonally modified by the addition of snow-ice treatment components. These components will include forwardly-mounted plows and rearwardly-mounted mechanisms for broadcasting materials such as salt or salt-aggregate mixtures. The classic configuration for the latter broadcasting mechanism includes a feed auger extending along the back edge of the dump bed of a truck. This hydraulically driven auger effects a metered movement of material from the bed of the truck into a rotating spreader disc or "spinner" which functions to broadcast the salt across the pavement being treated. To maneuver the salt-based material into the auger, the dump bed of the truck is progressively elevated as the truck moves along the highway or pavement to be treated.

Operating systems employed for these snow and ice control implements have been substantially improved over the past decade. An initial such improvement has been achieved through the utilization of microprocessor driven controls over the hydraulics employed with the seasonally modified dump trucks. See Kime, et al., U.S. Pat. No. Re 33,835, entitled "Hydraulic Systems Used with Snow-Ice Removal Vehicle, reissued Mar. 3, 1992. This Kime, et al. patent describes a microprocessor-driven hydraulic system for such trucks with a provision for digital hydraulic valving control which is responsive to the instantaneous speed of the truck. With the hydraulic system, improved controls over the extent of deposition of snow-ice materials is achieved.

This form of control has been employed to control the rate of salt deposition such that the granular material may be ejected from a delivery vehicle at a rate commensurate with the trucks forward speed. Such an arrangement conserves snow-ice materials and permits deposition at desirably higher truck speeds. See in this regard, Kime, et al, U.S. Pat. No. 5,318,226 entitled "Deposition of Snow-Ice Treatment Material from a Vehicle with Controlled Scatter", issued Jun. 7, 1994. This approach is sometimes referred to as a "zero-velocity" method for salt distribution.

Investigations into the chemical-physical phenomena of pavement borne ice formation have recognized the importance of salt in the form of a salt brine in breaking the bond of ice with underlying pavement. It is this brine, as opposed to mere granular salt, which reacts to attack ice formations. This phenomenon has lead to the development of improved techniques for generating brine of sufficient concentration to break the ice-pavement bond. For example, Kime in U.S. Pat. No. 5,988,535 entitled "Method and Apparatus for Depositing Snow-Ice Treatment Material on Pavement"; issued Nov. 23, 1999 describes the deposition of a granular salt-brine material on pavement as a continuous narrow band. The result of such deposition is a highly effective snowice treatment procedure with an efficient utilization of salt materials. An improvement in this technique is described in application for U.S. patent application Ser. No. 09/512,199 entitled "Method and Apparatus for Depositing Snow-Ice Treatment Material on Pavement" by Kime, filed Feb. 24, 2000 in which narrow band ejection of salt and brine is provided in a manner wherein it is encountered by the rear drive wheels of a dump truck. For both approaches of the above-described narrow band deposition, the dump truck structuring is such that use may be made of them for purposes other than snow-ice control during winter seasons. In this regard, highway maintenance organizations require that the dump trucks be capable of being used for such purposes as hauling gravel and/or pothole repair materials.

While substantial improvements have been recognized as with these brine formation snow-ice control systems, the majority of highway maintenance organizations continue to employ conventional highway maintenance dump trucks which are retrofitted each season with plows, a cross-bed auger which typically is bolted to the truck bed beneath the bed tailgate and a hydraulically driven spinner. Control over the rate of material feed generally is by the truck operator. When these trucks are utilized for winter maintenance purposes, the plows are uncoupled; the augers are covered with a plate arrangement and the spinner may be removed or pivoted out of the way. With the emergence of the above-rioted ice-pavement bond studies, the ubiquitous snow-ice control retrofit approaches now are called upon to additionally mount relatively large brine tanks which permit a substantially increased utilization of brine in combination with granular salt. The brine preferred, in terms of cost, is a sodium chloride solution. However, the amount of this form of brine called for in snow-ice treatment is quite substantial compared to alternate brines, such as calcium chloride based solutions which typically are orders of magnitude greater in cost but lower in amounts or volumetric requirements. Typically, the only practical location for the brine tanks is at the rear of these trucks, regions between the axles exhibiting little or no space for tank mounting. These polymeric tanks, in addition to being bulksome, when filled with brine solution are quite heavy and difficult to maneuver on and off trucks.

The Ohio Department of Transportation (ODOT) developed a combination tailgate assembly for winter season use. This assembly mounts the brine tanks at the rear of a tailgate and couples both the spinner and auger at the bottom of the tailgate. The combinational assembly then is mounted on a truck utilizing a conventional front-end loader. The maximum available brine tank capacity for the assemblies is about 70 gallons. An undesirable aspect of these devices resides in a rearward diversion of the center of gravity of the tailgate to the extent that, when the dump bed is raised, the tailgate will open only a few inches when the brine tanks are empty and not at all should they be filled. However, these combinational tailgate assemblies represent a substantial improvement in terms of convenience of mounting over the conventional bed-mounted auger-spinner approach.

On occasion, the dump trucks will be loaded with both salt and brine and sent out on patrol prior to the commencement of inclement weather. Where such weather fails to materialize, then these trucks will return to base at which point in time it is necessary that the salt load be dumped. Because the tailgates cannot be opened, it then becomes necessary to again use the front-end loader approach to remove the combinational tailgates entirely in order to carry out necessary salt dumping. The same problem is encountered where the trucks, for example, are dispatched to carry out plowing alone without salt treatment. To achieve necessary traction, the trucks are loaded with salt notwithstanding the fact that such salt is not dispersed. Accordingly, as the trucks return, again it is necessary to dump the salt, which cannot be carried out without removal of these non-pivoting combinational tailgates.

BRIEF SUMMARY OF THE INVENTION

The present invention is addressed to a vehicle and associated tailgate assembly, the latter being configured for snow-ice control procedures. Employing a tailgate frame supporting brine supply tanks which extend through that frame and pivotally mounting the frame rearwardly of a normal pivot position, the tailgate functions in a manner wherein its center of gravity resides at a vertical plane passing through the rearwardly disposed pivot connection. Thus, the tailgate assembly may pivot open when the vehicle dump bed to which it is attached is raised, having been unlatched by the operator. This opening occurs even though the tailgate carrying brine tanks may be full of brine fluid.

Liquid brine fluid weight distribution achieving the desired tailgate center of gravity is developed through the use of a tank cross section resembling an inverted, truncated right triangle. Thus configured and oriented, the tank assembly extends inwardly through the tailgate frame. With this arrangement, substantial enhancement of the volumetric capacity also is realized while desired opening pivoting performance of the tailgate is achieved. In this regard, for a preferred embodiment, tank capacity is elevated from about 70 gallons to about 140 gallons and this enhancement is evolved with a desired truck rear end tank mounting.

Carried by the tailgate frame beneath the brine tank assembly is a cross transport mechanism implemented as an auger carrying a sequence of flights which are driven from first to last to maneuver particulate material essentially across the widthwise extent of the vehicle dump bed into an outlet . From this outlet the material passes to a broadcasting assembly implemented as a hydraulically driven spinner. The feed opening of this auger is an elongate one generally presented to the widthwise extent of the dump bed of the vehicle. Ingress of the salt material into the auger for distribution to the outlet is made possible and facilitated by the noted sloping forward wall of the brine tank assemblage. That sloping wall serves to overcome any tendency of the granular salt materials to "bridge" or coalesce and fail to move towards the auger-based transport mechanism.

Because it is desirable to admix a substantial amount of brine fluid with particulate salt materials, fluid brine from the brine tank assemblage is introduced to that granular salt at a location adjacent the noted last flight of the auger assembly. Thus, the last flight is utilized as a mixing device for developing a brine-salt slurry ultimately to be deposited or broadcast from the spinner assembly.

Simple mounting of the tailgate assembly to the rims of the dump bed walls at the rearward portion of the dump bed is carried out utilizing two links, one positioned at each side of the tailgate and having rearward apertures formed therein pivotally coupled with the upper region of the tailgate frame. Each link additionally contains a medial aperture and a forward aperture. In this regard, medial aperture is connected with the "normal" tailgate pivoting mechanism attached to the dump bed rims. The forward aperture is coupled with an installed stabilizing bracket through the utilization of pin connections for the latter two apertures. Mounting of the tailgate assembly to the dump bed readily is carried out utilizing, for example, a front end loader.

Other objects of the invention will, in part, be obvious and will, in part, appear hereinafter.

The invention, accordingly, comprises the apparatus possessing the construction, combination of elements and arrangement of parts which exemplify the following detailed description.

For a fuller understanding of the nature and objects of the invention, reference should be had to the following detailed description taken in connection with the accompanying drawings.

DETAILED DESCRIPTION OF THE INVENTION

Figure 1:
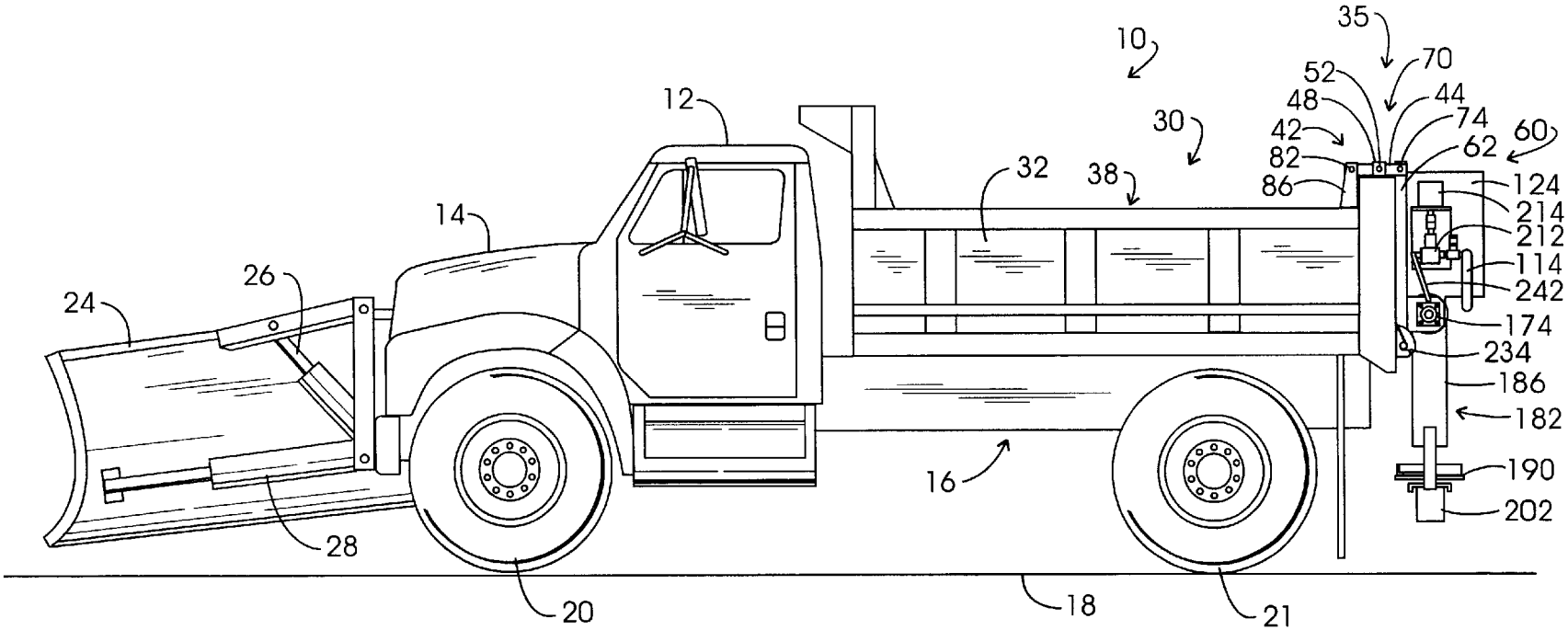
FIG. 1 is a left side elevational view of a truck outfitted with apparatus according to the invention showing its tailgate assembly in a closed orientation.

Referring to FIG. 1, a utility vehicle retrofitted for the seasonal duties of snow-ice removal is revealed generally at 10. Configured as a dump truck, vehicle 10 includes a cab 12 and hood 14 mounted upon a frame represented generally at 16. Frame 16 is supported upon pavement represented at 18 by four wheel assemblies, two of which are revealed at 20 and 21. At the forward end of the vehicle 10, there is mounted a front snowplow 24 which is removed by maintenance personnel when the vehicle 10 is called upon for winter duties other than snow-ice control. The front plow 24 is elevationally maneuvered by up-down hydraulic cylinder assembly 26. Additionally, this front plow 24 is laterally, angulary adjusted by left-and right-side hydraulic cylinder assemblies, the left side one of which is represented at 28. Not shown in the figure is a wing plow which is mounted adjacent the right or left fender of the vehicle 10, and which functions generally as an extension of the front plow 18, serving to push snow off of a shoulder. Also not shown is an underbody scraper plow which is a heavy duty plowing apparatus mounted beneath the vehicle 10 and which functions to utilize the weight of the vehicle 10 to peel or remove hard packed ice or snow at the pavement 18. Vehicle 10 supports a dump bed represented generally at 30. Looking additionally to FIG. 8, the bed 30 is seen to be formed with oppositely disposed sides 32 and 34 which are spaced apart a bed width and extend with the bed floor 36 to a bed end 35. These sides 32 and 34 extend upwardly from bed floor 36 to respective bed rims represented at 38 and 40. Rims 38 and 40 are seen to be slightly elevated at rear posts adjacent the rear end of 42 of bed 30 as shown respectively at 44 and 46.

Figure 4:
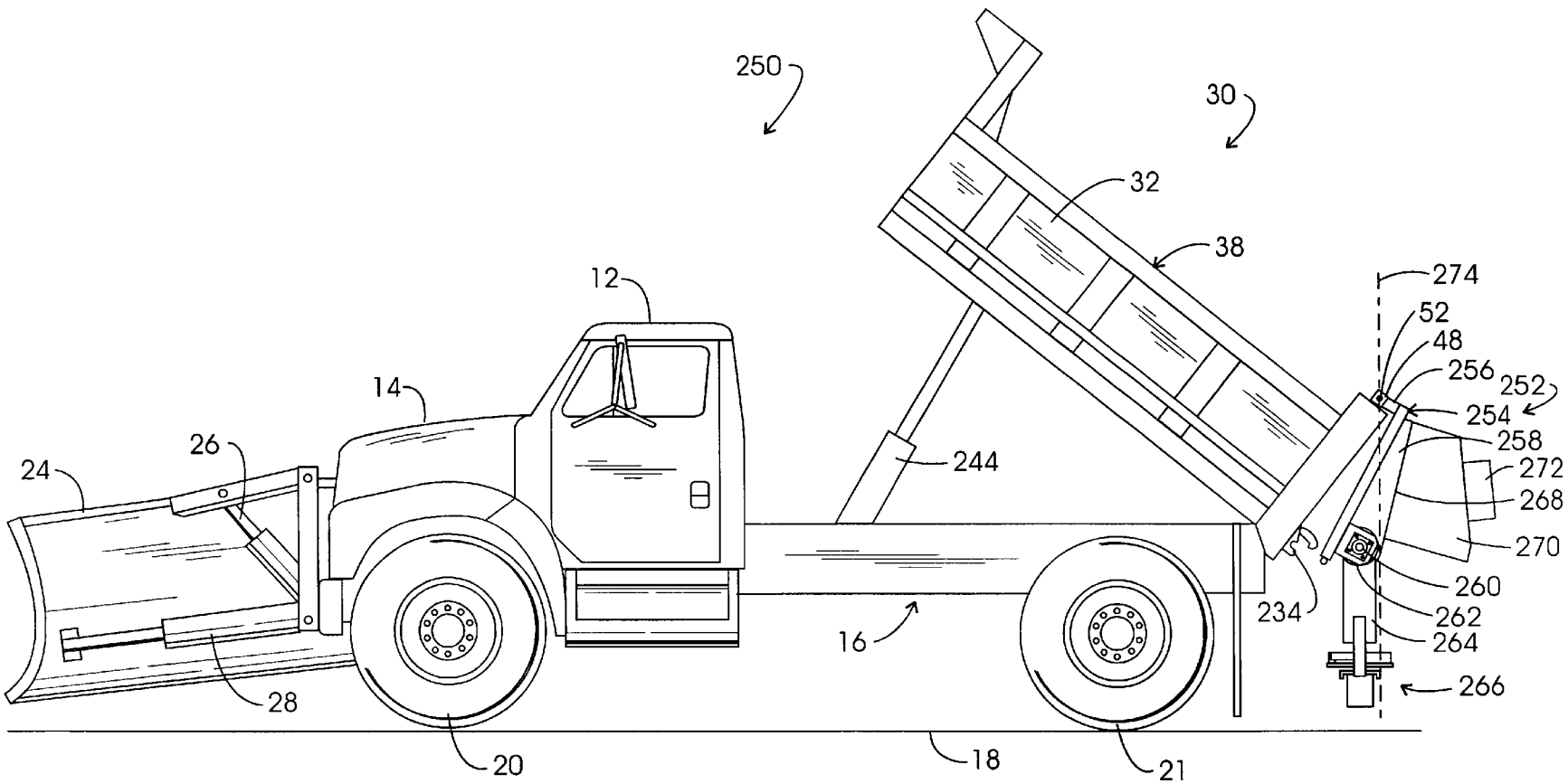
FIG. 4 PRIOR ART
FIG. 4 is a left side elevational view of a truck having a modified tailgate configured in accordance with the prior art and showing the tailgate in a released orientation for opening.
Figure 8:
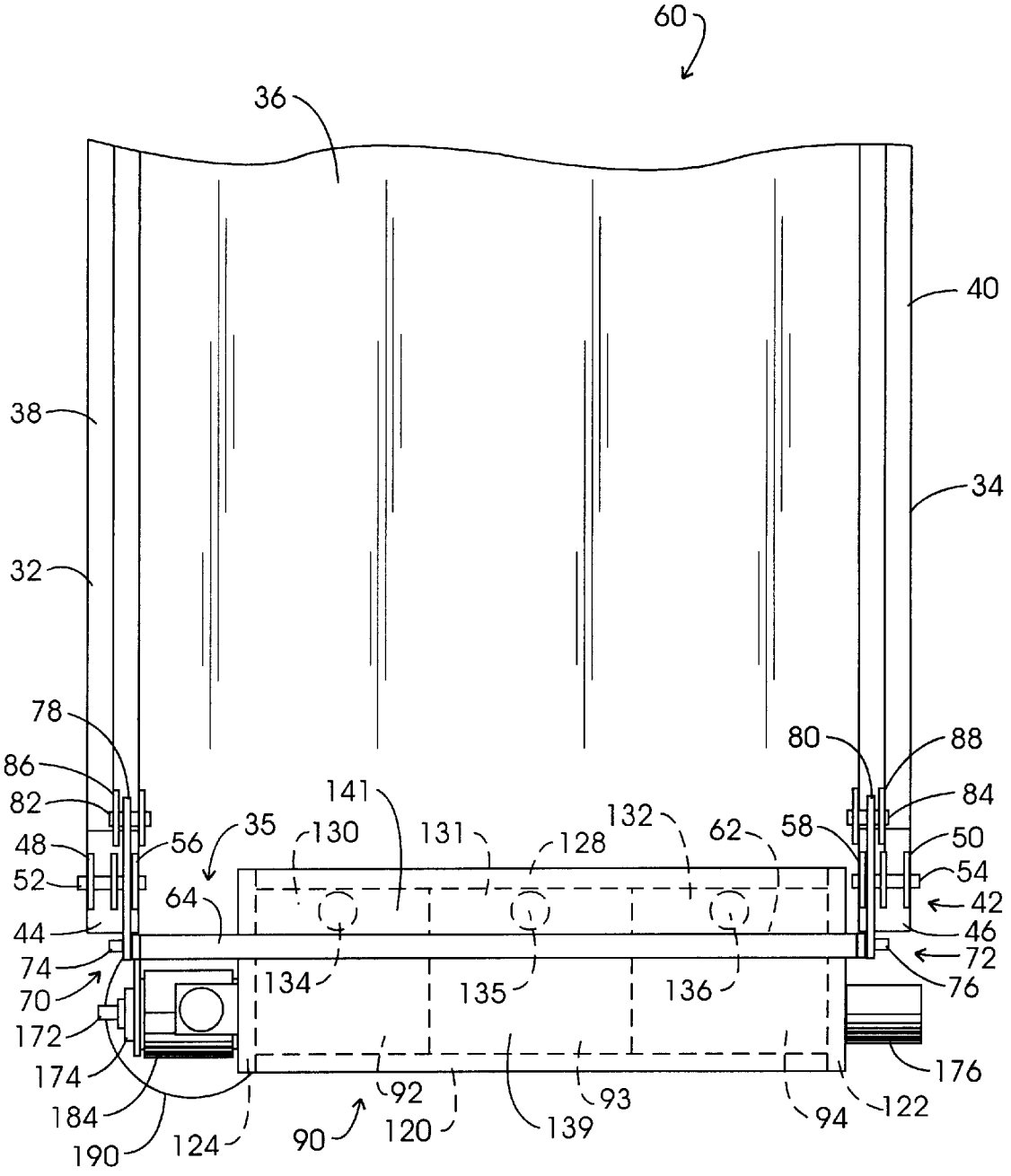
FIG. 8 is a partial top view of the truck of FIG. 1.

As revealed additionally in FIGS. 4 and 8 rim elevated portions 44 and 46 support respective upstanding, generally u-shaped pin retention brackets 48 and 50. Brackets 48 and 50 function with robust rigid pins or connectors shown respectively at 52 and 54 (FIG. 8) which are located to define "normal" pivot mechanisms at "normal" pivot positions which will be encountered with a standard tailgate assemblage. In this regard, the "normal" pivot position provided by the bracket and pin mechanisms 48–52, 50–54 are somewhat centered upon the respective elevated rim components 44 and 46, i.e., forwardly of bed end 35.

The rearward region of dump bed 30 supports a tailgate assembly represented generally at 60 within which there are integrated snow-ice control features including an auger, a spinner, and importantly, a brine tank storage arrangement having a volumetric capacity which is substantially improved over assemblies of the past. The latter feature is so integrated and configured within the frame of the tailgate assembly 60 that the tailgate will open even though the brine tanks may be full and, thus, the assembly 60 may remain in place as vehicle 10 is used for purposes other than snow-ice control, i.e., transporting gravel and/or pothole repair materials during the winter season, no temporary removal being required.

Figure 5:
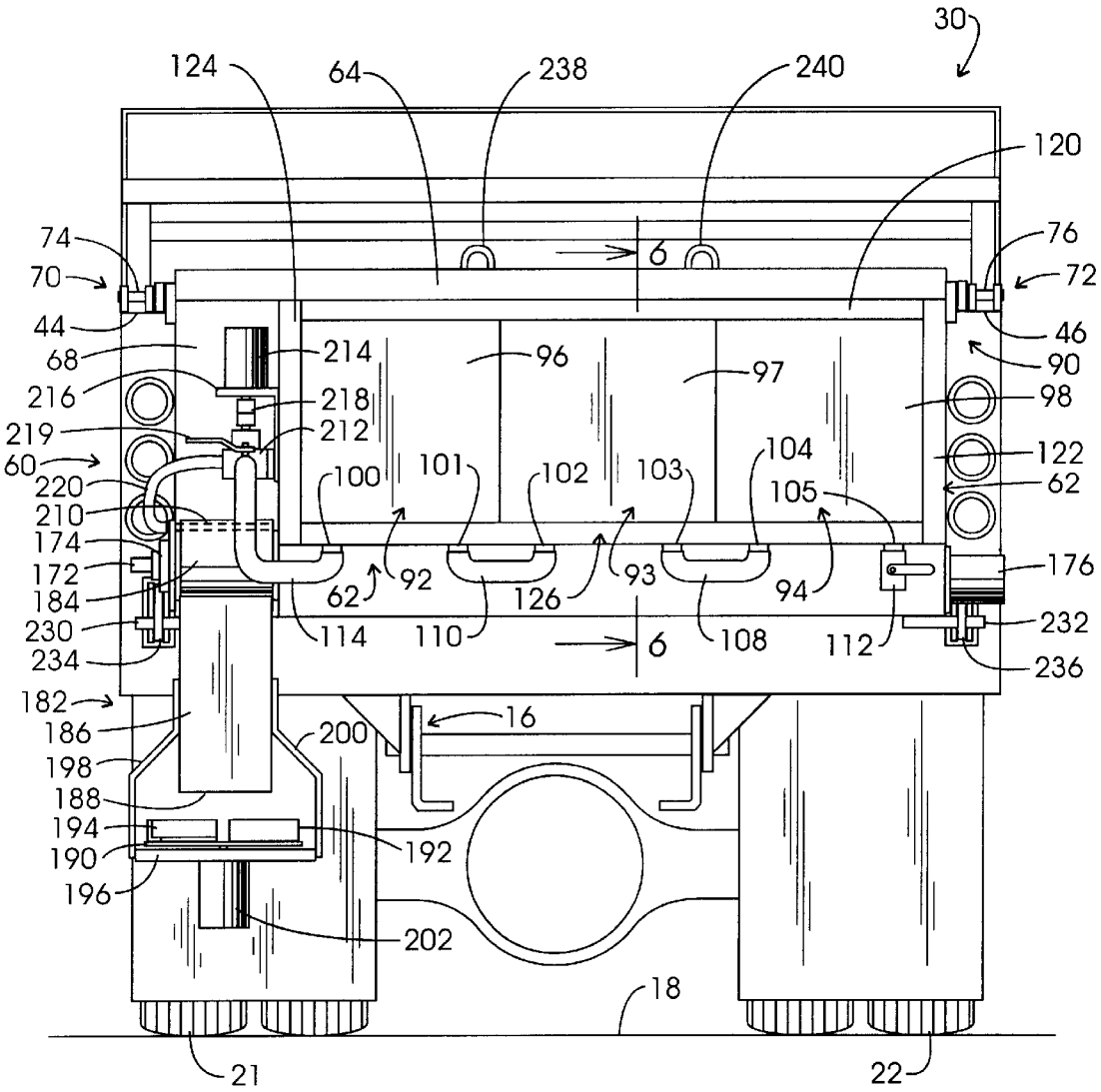
FIG. 5 is a rear view of the truck of FIG. 1.
Figure 6:
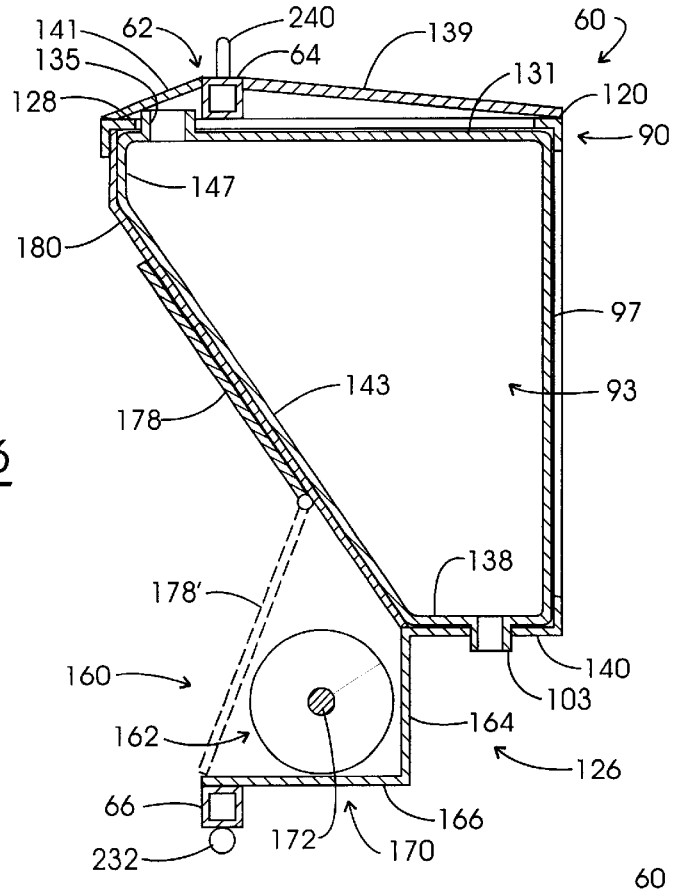
FIG. 6 is a sectional view taken through the plane 6—6 in FIG. 5.
Figure 7:
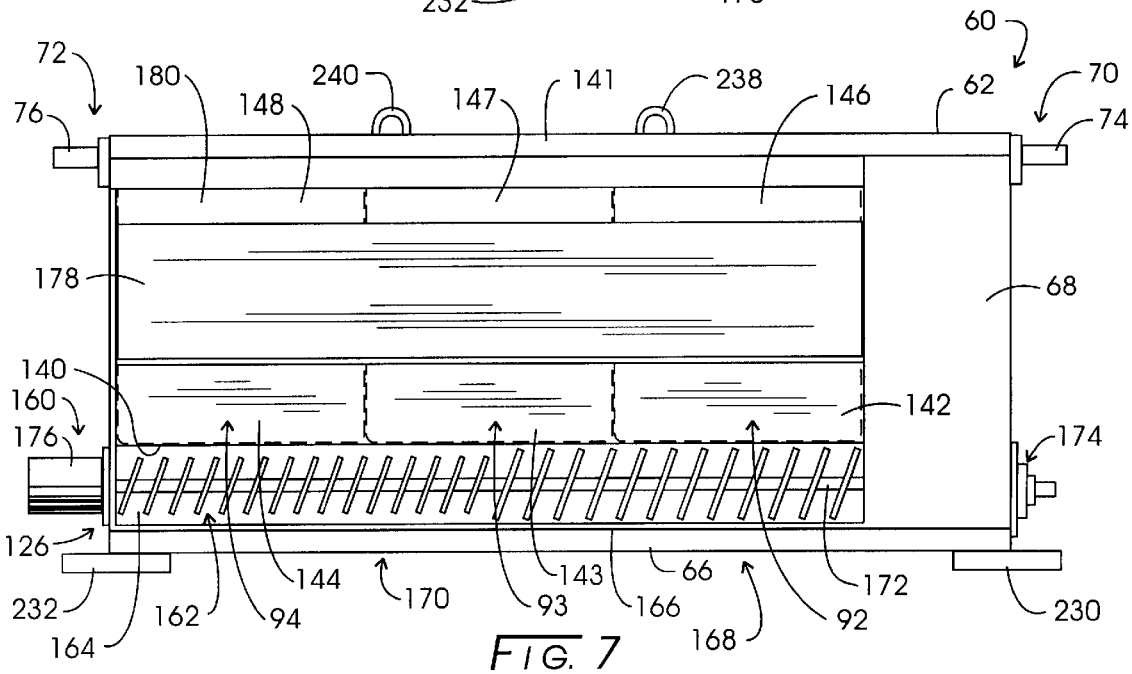
FIG. 7 is a plan view of the forward facing side of the tailgate assembly employed with the vehicle of FIG. 1.

Integrated features of the tailgate 60 are realized through the utilization of an open rigid tailgate frame represented generally at 62. FIGS. 5 and 6 reveal that the frame 62 includes upper and lower steel transverse box beams 64 and 66 which, in general, have a widthwise extent corresponding with the widthwise extent of the dump bed 30. FIG. 6 and 7 reveal that the beams 64 and 66 are parallel and weldably joined to and spaced apart by an upstanding, relatively wide rearwardly opening channel-shaped side member seen in FIGS. 5 and 7 at 68. The opposite or right side of the frame 62 is configured having an upstanding box beam (not shown) which is welded to and extends between the transverse beams 64 and 66. Thus, a form of open frame assembly is provided. FIGS. 5, 7 and 8 reveal that the frame 62 is pivotally connected to the dump bed 30 at rear region 42 by oppositely disposed tailgate pivot mechanisms represented generally at 70 and 72. The tailgate mounted components of these mechanisms are provided as an outwardly extending upwardly disposed shaft or pin and support plate 74 at mechanism 70 and a corresponding outwardly horizontally extending shaft or pin and support plate 76 at mechanism 72. The pins of these assemblies 74 and 76 are seen, as represented in FIGS. 1–3 and 8, to pivotally extend through the outboard or outer apertures of respective steel links 78 and 80. These figures reveal that in addition to this pivotal connection with the tail gate frame 62, the links 78 and 80 form two additional forwardly disposed connections one at a middle or medial aperture which receives an earlierdescribed "normal" pivot position located pin. In this regard, for example, "normal" pivot position pin connector 52 is elongated to extend into an auxiliary bracket 56 (FIG. 8) and through the middle aperture of link 78, while "normal" pivot position pin 54 is elongated to extend into an auxiliary bracket 58 and through the corresponding middle aperture of link 80. To stabilize these links 78 and 80 from rotation tendency about these central connections at pins 52 and 54, the links 78 and 80 are each formed with an inward or forward aperture, which is engaged by respective pins 82 and 84. Pins 82 and 84 are retained in position by virtue of their connection with respective bifurcate stabilizing brackets 86 and 88. These brackets 86 and 88, in turn, are weldably connected with bed rim 38 of side 32 and bed rim 40 of side 34. With the pinned assemblage shown, the entire tailgate assembly may be pivotally mounted upon and removed from the rearward region 42 of dump bed 30.

The center of gravity exhibited by the thus pivotally connected tailgate assembly 60 is developed through a combination of positioning the upper tailgate frame pivots 74 and 76 rearwardly from the normal pivoting location represented at pins 52 and 54, and rearwardly from the bed end 35 and by supporting the brine tanks through the tailgate frame 62. The tanks are arranged such that they extend forwardly through frame 62 and are retained therein by an assembly of brackets and side plates represented in general at 90 in the rear view shown in FIG. 5. That bracket and side plate assembly 90, in turn, is weldably connected to the tailgate frame structure 62. FIG. 5 reveals the presence of three polymeric brine tanks 92–94 retained by this assembly of brackets, bottom support structure and side plates. That figure shows the somewhat normally vertically oriented rear walls of tanks 92–94 respectively at 96–98. Extending from the bottom wall of each of the tanks 92–94 are lower disposed brine outlet port assemblies, each comprised of right and left output ports. In this regard, tank 92 is formed with left output and right output-input ports shown respectively at 100 and 101; tank 93 is formed with left and right output-input ports shown respectively at 102 and 103; and tank 94 is shown with left and right output ports 104 and 105. Port 105 is coupled with a combined fill and drain valve 112 functioning with part 105 as an input assembly as well as a drain valve. Ports 103 and 104 are connected by a polymeric conduit 108 which functions to couple tanks 93 and 94 in fluid transfer or cascading relationship. Similarly, ports 101 and 102 are connected by a polymeric conduit 110 which serves the same fluid transfer or cascading function. That fluid transfer function performs in either of two directions. The tanks are draining in a rightward brine emptying application by opening outlet valve 112 coupled to port 105 or in a leftward sense delivering brine to the salt dispensing function via polymeric conduit 114. The tanks are filled by injecting brine under pressure into an open valve 112, filling being carried out in a cascading manner. Venting as described later herein facilitates the filling and draining procedure. Certain of the components of the assembly brackets, bottom support frame and side plates 90 are seen in FIG. 5 as a rearward top support bracket 120; right side plate assembly 122; left side plate assembly 124 and a bottom support frame represented generally at 126. A downwardly sloping rearward protective metal shield is seen at 139.

Looking momentarily to FIG. 8, right and left side plate assemblies 122 and 124 again are revealed in conjunction with top rearward support bracket 120 and top forward support bracket 128. In the figure, the top walls of tanks 92–94 are shown respectively at 130–132. Each of the top walls includes an upwardly disposed brine tank vent assembly, the circular openings of which are shown respectively at 134–136. These vents are positioned forwardly in adjacency with the vertical wall portions of the tank forward walls. This avoids spillage when bed 30 is lifted. Note in the figure that the top walls 130–132 extend inwardly or forwardly from the frame 62. With this arrangement, when the tanks 90–94 are filled with brine, the substantial weight represented by the loaded tanks will be partially shifted forwardly and, concomitantly the center of gravity is moved closer to a vertical plane extending through frame 62. This forward shift is effective to permit the tailgate assembly 60 to open to an extent fully adequate to permit unfettered dumping activities.

A transverse cross-section revealing the profiles of tanks 92–94 is shown in FIG. 6. Looking to that figure, the tank 93 again is seen to be secured along the edges of its top wall 131 by top rearward support bracket 120 and top forward support bracket 128. The bottom wall 138 of tank 93, incorporating the right fluid conveyance port 103, is seen to be ultimately supported by an elevated platform portion 140 of bottom support 126. The forward wall 143 of tank 93, as well as the corresponding forward walls 142 and 144 of respective tanks 92 and 94, are formed integrally with bottom walls as at 138 and top wall 131 but slope angularly forwardly from their bottom walls as at 138 to vertical portions which are formed integrally with top walls as at 131. Thus, forward wall 143 extends to vertical wall portion 147 which, in turn, is formed integrally with top 131. The configuration of tanks 92–94 wherein the inwardly facing tank walls as at 142–144 slope upwardly inwardly evolves two necessary aspects of the tailgate assembly of the invention. First, the inwardly depending nature of these forward walls 142–144 shifts the center of gravity of the tailgate assembly 60 inwardly or forwardly when the tanks are loaded with brine. Next, the slope permits and, in fact, facilitates the movement of salt within the truck bed 30 into a bed cross transport mechanism implemented as an auger. In this regard, should the tanks 92–94 have been provided with a rectangular cross-sectional configuration, salt would not be able to flow along the dump bed 30 into that cross transport mechanism.

The slope of walls 142–144 is about 34° with respect to vertical or 56° with respect to the tank bottom walls. Note that this figure reveals the rearward protective metal shield, as well as a downwardly sloping forward protective metal shield 141.

The above-noted cross bed transport mechanism is represented in general at 160. Mechanism 160 is implemented as an auger represented generally at 162 which extends adjacent a back plate portion 164 and bottom plate portion 166 of bottom support 126. That bottom support 126 is seen to be weldably connected to lower transverse frame member 66. FIG. 7 reveals that the auger 162 is comprised of two flight regions represented generally at 168 and 170 which are mounted upon a common shaft 172. The motion of travel of granular material will be from the region 170 toward the region 168, the latter region extending to a wetting and dispensing function. Note that a flight structure of larger diameter is provided at region 168. Shaft 172 is supported between a bearing assembly 174 and a hydraulic motor 176. To protect the transport mechanism 160 when the vehicle 10 is utilized for duties other than snow-ice control, the region surrounding it is enclosed by an elongate protective plate or buffer 178. In this regard, the plate 178 is manipulated by an external arm or crank such that it is manipulated into the orientation shown in sold line fashion in FIG. 6 during active use of the transport mechanism 160 and is maneuvered to the downwardly directed orientation represented in phantom at 178' when the transport mechanism 160 is not in use. To provide protection for the forward walls 142–144 of polymeric tanks 92–94, a thin metal shield 180 is positioned in abutment with the outer surface of these inwardly directed walls.

Cross bed transport mechanism 160 feeds granular salt material, i.e., salt, into a broadcasting assembly represented in general at 182. Looking to FIG. 5, assembly 182 is seen to comprise a cylindrically shaped feed input chamber 184 pivotally mounted over shaft 172. Downwardly depending from the input chamber 184 and pivotal therewith is a feed chute 186 extending to a chute opening 188. Mounted upon the chute 186 at a location just below opening 188 is a drivably rotatable disc or "spinner" 190. Disc 190 supports a plurality of vanes two of which are shown at 192 and 194. The disc 190 is rotatably mounted upon a disc platform 196 which, in turn, is supported from the feed chute 186 by brackets 198 and 200. A hydraulic motor 202 is supported upon the underside of platform 196 and is coupled in driving relationship with the disc 190. Accordingly, with the maneuvering of granular material into the feed input chamber 184, such material drops upon the rotating disc 190 and is broadcast upon the roadway or pavement 18.

In keeping with current procedures calling for the utilization of substantial amounts of brine in combination with granular salt material to attack the ice-pavement bond, brine from the enhanced capacity tanks 92–94 is delivered to the feed input chamber 184, whereupon it is directed via a rigid polymeric pipe seen in phantom at 210 to be expressed into the final flight components of the auger 162. This provides for an improved mixing of the brine with particulate salt material and the result is a form of granular salt and brine slurry which is delivered into the chamber 184, through chute 186 and on to the disc 190 for broadcasting. This brine fluid is drawn from conduit 114 through a check valve (not shown) by a hydraulic pump 212 which is driven, in turn, by a hydraulic motor 214. Motor 214 and pump 212 are mounted upon a bracket 216 which in turn, is weldably connected to left side plate assembly 124. Driven association between the motor 214 and pump 212 is through a coupling 218. Additionally, coupled to conduit 214 is a shutoff valve, the hand actuated lever for which is represented at 219. The output of pump 212 is provided at a flexible conduit 220 extending to the input of pipe 210.

The control system for operating hydraulic motors 176 and 214 as well as spinner motor 202, in general, may be combined with the overall vehicle hydraulic system. That system also will control plow orientations and the dump bed. A variety of these systems are available. However, a preferred arrangement is the microprocessor driven system described in U.S. Pat. No. Re 33,835 (supra) which is incorporated herein by reference.

FIGS. 5 and 7 further reveal that the tailgate frame 62 supports two, oppositely disposed closure assemblies 230 and 232 which are provided for the present embodiment, as outwardly extending latching pins configured in conventional manner. These pins 230 and 232 are engagable by a conventional bayonet-type quick disconnect cam latch or tailgate latch. In this regard, tailgate latch 234 is shown engaging latching pin 230 and tailgate latch 236 is shown engaging latching pin 232. In conventional fashion, these latches 234 and 236 are actuated to open and closed orientations by an operator lever (not shown) typically located upon the bed 30 adjacent cab 12.

FIGS. 5 and 7 further reveal the presence of two, spaced apart lift connectors 238 and 240 which are welded to transverse box beam 64. These connector devices are utilized in conjunction with, for example, a front end loader to maneuver the tailgate assembly 60 on to and off of dump bed 30.

Returning to FIG. 1, the dump bed 30 is shown in its down position preparatory to being loaded with snow-ice control material. A lever 242 coupled to baffle or protective plate 178 (FIG. 6) is shown in an orientation wherein that plate 178 is in its upper or solid line orientation shown in the latter figure. Feed chute 186 is shown in a vertical orientation and disc 190 is in a horizontal orientation. The latches as at 234 and 236 have engaged the latching pins 230 and 232 to retain the tailgate assembly 60 in securement against the rear region 42 of dump bed 30.

Figure 2:
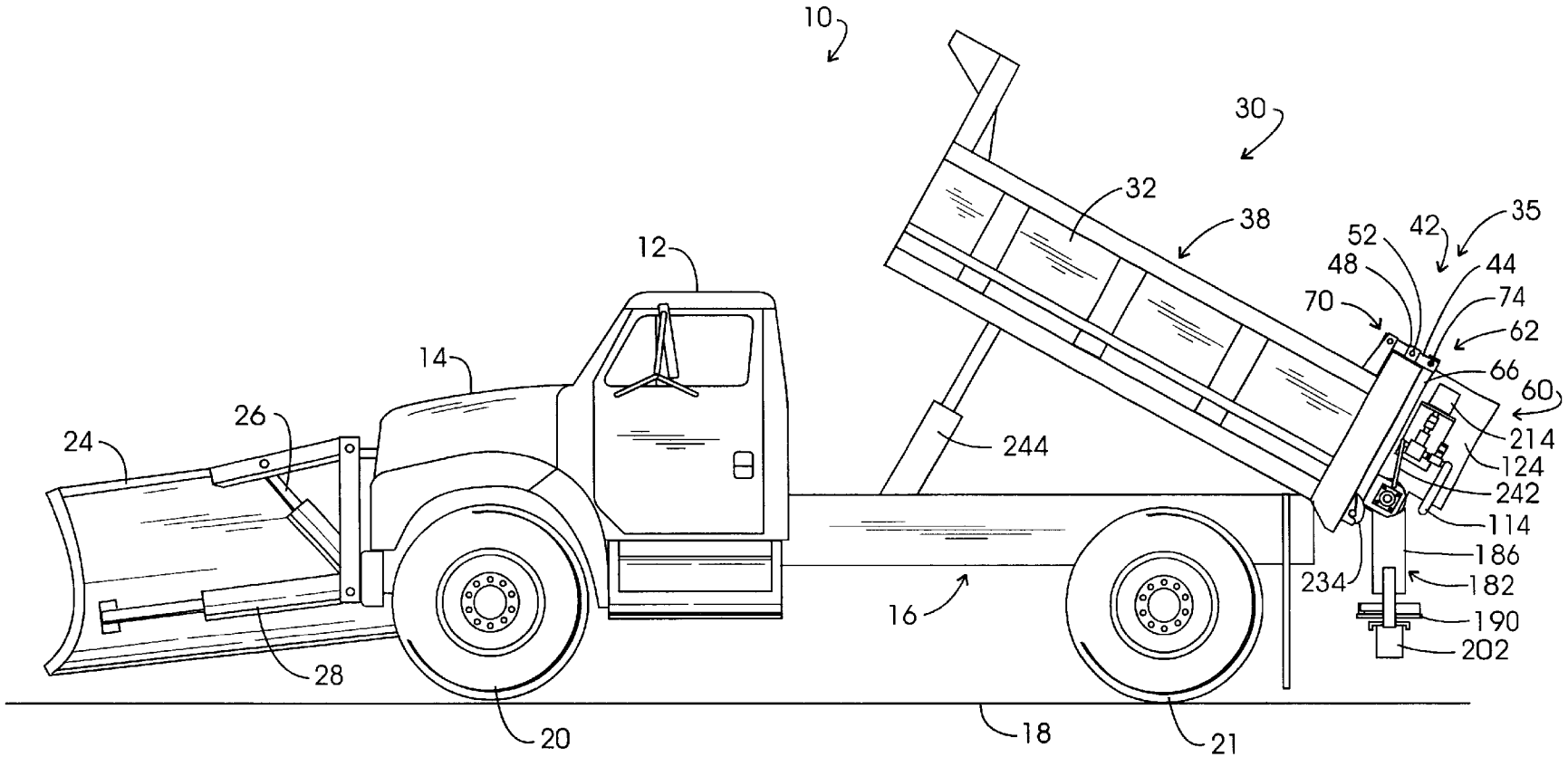
FIG. 2 is a left side elevational view of the truck of FIG. 1 showing an elevated dump bed with the tailgate assembly in a latched orientation.

Looking to FIG. 2, dump bed 30 is shown in an orientation having been elevated by a hydraulic cylinder arrangement 244 in the course of salt deposition. In this regard, the latches 234 and 236 remain in engagement with respective latching pins 230 and 232. Note that the feed chute 186 remains in a vertical orientation and disc 190 remains in a horizontal orientation.

Assuming that the driver of the vehicle 10 has returned to base at the end of a patrol with a quantity of granular salt material within bed 30 as well as brine within tanks 92–94, then it is necessary to dump that remaining salt at the storage facility. The arrangement of tailgate 60 permits that to occur. Looking to FIG. 3, the dumping orientation for such a situation is revealed. The operator has released the cam latches 234 and 236. Because the pivot position for the tailgate 60 has been moved to the pin position 74 spaced rearwardly from the normal position, for example, at 52, and because the forward walls 146–148 of brine tanks 92–94 extend forwardly through the tailgate frame assembly 62, the center of gravity of the entire assembly 60 has been moved forwardly. That center of gravity lies within a plane represented at vertical dashed line 246. Note that the tailgate assembly 60 is adequately open to permit dumping of the remaining salt. This condition will obtain even though the brine tanks 92–94 are filled with brine.

Where the vehicle 10 is employed for purposes other than snow-ice control, for example, conveying gravel or pothole repair material, the lever 242 may be actuated to close the plate 178 (FIG. 6) to its position shown in phantom at 178'. Gate 60 will open to the same orientation shown in FIG. 3 to permit this supplemental use of the vehicle 10 without removal of the integrated version of the tailgate 60 described herein. As noted above, with the arrangement, the important capacity of the brine reservoir as represented at brine tanks 92–94 is doubled with this integrated configuration, that capacity permitting the utilization of less expensive sodium chloride salt-based brine with requisite modem mixing ratios selected to defeat the ice-pavement bond. As noted above, the capacity for the instant embodiment reaches about 140 gallons. For the noted alternate winter seasonal use of the vehicle 10 as incorporating tailgate assembly 60, the broadcasting assembly 182 is pivoted upwardly and secured in position against the tailgate frame 62.

Figure 3:
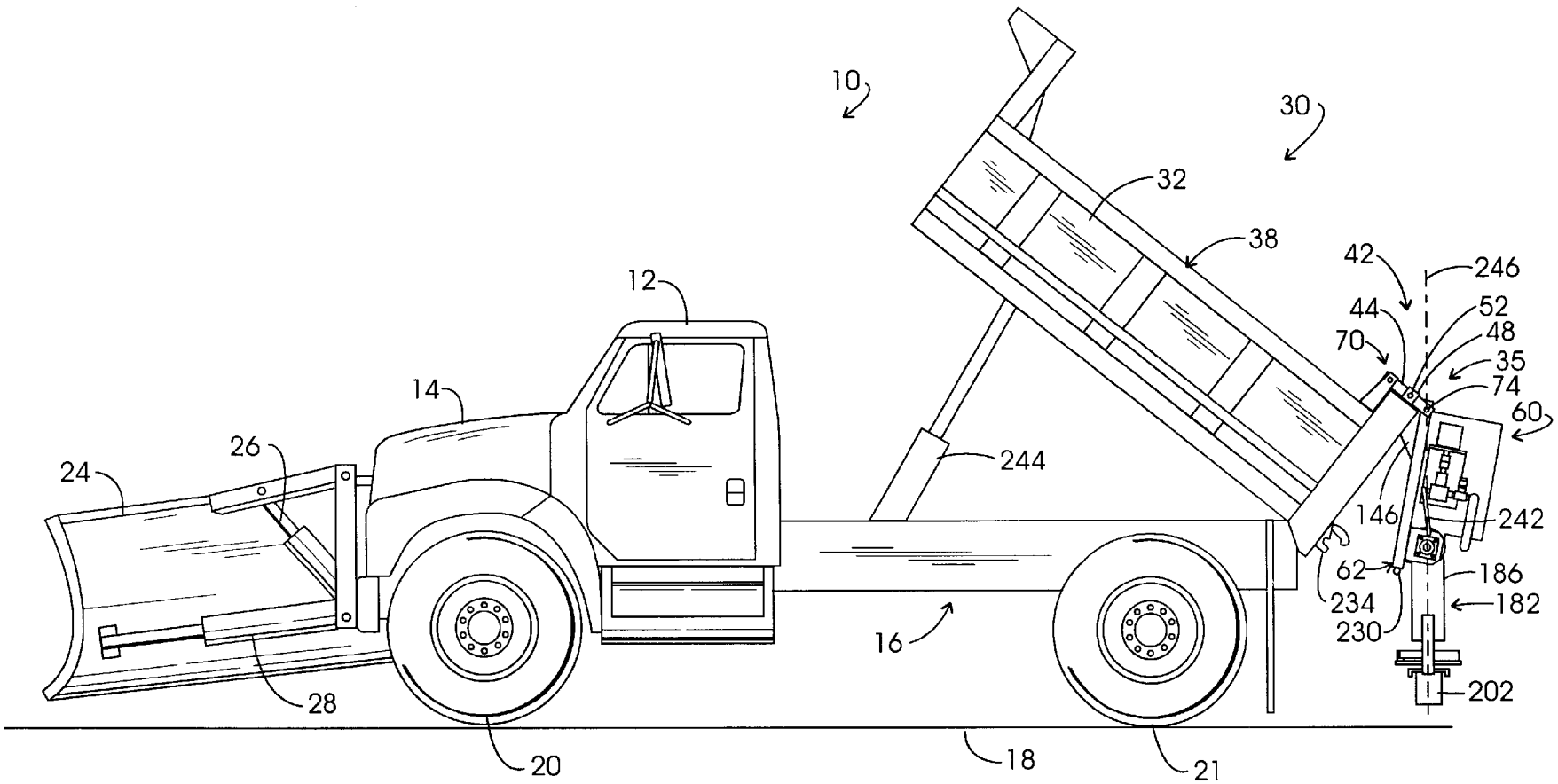
FIG. 3 is a left side elevational view of the truck of FIG. 1 showing an elevated dump bed and a tailgate assembly released for pivotal outward movement.

FIG. 4 illustrates the performance of one version of the current (ODOT) approach employing a combinational tailgate assembly. An identical vehicle as represented at 10 in FIGS. 1–3 is represented in general at 50. In view of this identity of general structure, identifying numeration for the truck components and associated bed which remain the same are provided with the same numeration as the other figure. The tailgate for utility vehicle 250 is represented generally at 252 and includes a tailgate frame represented generally at 254. On upper sides of frame 254 there is weldably provided an upper support component one of which is represented at 256. These components as at 256 extend to a hinge or pin connection with the "normal" pin retention bracket 48 and associated pin 52. The oppositely disposed connection is identical. Rearwardly of the frame 254, the tailgate 252 is configured having a transport mechanism chamber 258 of generally triangular cross section, the lower portion of which supports a bed transport mechanism implemented as an auger having a shaft 260 and a feed chamber 262. A feed chute 264 supporting a disc or spinner assembly 266 pivots with the feed chamber 262 about the shaft 260. Mounted upon the rearward surface 268 of transport mechanism 258 is a polymeric brine tank represented at 270. Note that the tank 270 does not extend through the tailgate frame 254. Mounted upon the outer surface of the middle one of the brine tank 270 is a hydraulic pump housing 272. This arrangement provides for a brine storage capacity of about 70 gallons. When the vehicle 250 is in the dumping orientation represented in FIG. 4 which is the same orientation as shown in FIG. 3, the center of gravity of the thus mounted tailgate 252 may be represented as being present in a vertical plane represented by dashed line 274. When the brine tank assembly 270 is essentially empty, the amount of tailgate opening will be as shown, for example, about 5½ inches. Where those brine tanks contain brine, the tailgate will not open.

Since certain changes can be made in the above-described apparatus and method without departing from the scope of the invention herein involved, it is intended that all matter contained in the above description or shown in the accompanying drawings shall be interpreted as illustrative and not in a limiting sense.

What is claimed is:

1. A tailgate assembly for a highway maintenance vehicle having a dump bed for conveying snow-ice granular treatment material with oppositely disposed sides spaced apart a bed width, each extending upwardly from a bed floor to first and second bed rims and rearwardly to an upwardly disposed rearward end, said first and second rims having first and second tailgate normal pivot positions, said bed having first and second rearwardly extending tailgate latches actuable to engage and release the lower edge closure assemblies of a tailgate, comprising:

a tailgate frame having a widthwise extent generally corresponding with said bed width, extensible vertically from oppositely disposed first and second pivot mechanisms defining respective first and second frame pivot locations removably connectable with a said bed rim in rearwardly disposed adjacency with respective said first and second tailgate normal pivot positions;

a brine tank assembly of predetermined volumetric fluid retention capacity mounted within said frame and having forward, rearward, bottom, top and side walls defining said volumetric capacity, said forward wall extending inwardly from said frame to an extent effective to establish a tailgate center of gravity at a vertical plane extending through said first when the tailgate frame is hung from said first and second pivot locations and said brine tank assembly second pivot locations and having an output port assembly and an input assembly;

a transport mechanism mounted upon said tailgate frame adjacent said brine tank bottom wall, having a sequence of drivable flights extending along said frame widthwise extent, having an inwardly disposed feed opening and an outlet through which said granular treatment material is conveyed when said flights are driven;

a transport mechanism motor supported by said tailgate frame and actuable to drive said flights;

a broadcasting assembly, supported by said tailgate frame, having a feed input adjacent said transport mechanism outlet and drivable to effect the broadcasting of said granular treatment material;

a broadcasting motor coupled in driving relationship with said broadcasting assembly;

a brine pump assembly mounted upon said tailgate frame, having an input coupled in fluid flow relationship with said brine tank assembly brine outlet port assembly and having an output adjacent said transport mechanism; and first and second closure assemblies coupled to and extending outwardly from said tailgate frame at locations for locking engagement with and release from respective said first and second tailgate latches.

2. The tailgate assembly of claim 1 in which said tailgate frame first and second pivot mechanisms comprise respective first and second links, each having three longitudinally spaced apart outer, medial and inward apertures, and first and second pivot pins extending mutually oppositely outwardly from said tailgate frame widthwise extent and pivotally engaged with the said outer aperture of respective said first and second links.

3. The tailgate assembly of claim 2 in which: said medial aperture of said first and second links is configured for pivotal engagement with said bed rim at respective said first and second tailgate normal pivot positions.

4. The tailgate assembly of claim 3 in which said medial aperture of said first and second links is spaced from said outer aperture a distance defining respective said first and second frame pivot locations.

5. The tailgate assembly of claim 4 in which said inward aperture of said first and second links is connectable by pins with a said bed rim.

6. The tailgate assembly of claim 1 in which said forward wall and side walls of said brine tank assembly are configured sloping forwardly and upwardly through said tailgate frame.

7. The tailgate assembly of claim 6 including a bottom support assembly with a bottom plate connected to said tailgate frame and extending beneath said transport mechanism, a back plate portion extending upwardly from said bottom plate in rearward adjacency with said transport mechanism, and an elevated platform portion extending in supporting relationship beneath said bottom wall.

8. The tailgate assembly of claim 6 including a buffer plate pivotally mounted with said tailgate frame and movable between an orientation in adjacency with said brine tank assembly forward wall and an orientation covering said transport mechanism feed opening.

9. The tailgate assembly of claim 6 in which said forward wall of said brine tank assembly is configured to provide an elongate upper particle guide surface extending to said feed opening of said transport mechanism.

10. The tailgate assembly of claim 9 in which said forward wall of said brine tank assembly is oriented with respect to said bottom wall at an angle of about 56°.

11. The tailgate assembly of claim 1 including:

a venting assembly extending through said brine tank assembly top wall; and a metal shield coupled to said tailgate frame and extending over said venting assembly.

12. A vehicle comprising a frame supporting forwardly and rearwardly disposed wheel assemblies, an engine and a cab, a dump bed supported upon said frame with oppositely disposed first and second sides spaced apart a bed width, each extending upwardly from a bed floor to first and second bed rims and rearwardly to a bed end, said first and second rims supporting respective first and second normal pivot mechanisms adjacent said bed end defining respective first and second tailgate normal pivot positions and said bed supporting oppositely disposed first and second tailgate latches adjacent said bed floor at said bed end, the vehicle further comprising:

a tailgate frame having a widthwise extent generally corresponding with said bed width, said frame being pivotally extensible from oppositely upwardly disposed first and second frame pivot positions;

first and second tailgate pivot mechanisms respectively pivotally coupled with said tailgate frame at said first and second frame pivot positions, extensible to removable connection with said first and second normal pivot mechanisms and configured to locate said first and second frame pivot positions outwardly rearwardly from said bed end;

a transport mechanism mounted upon said tailgate frame, having a sequence of drivable flights extending along said frame widthwise extent, having an elongate inwardly disposed feed opening and an outlet through which said granular treatment material is conveyed when said flights are driven;

a transport mechanism motor supported from said tailgate frame and actuable to drive said flights;

a brine tank assembly supported by said tailgate frame, having forward, rearward, bottom, top and side walls, said bottom wall being supported above said transport mechanism, said forward wall extending from said bottom wall adjacent said feed opening and configured to promote the movement of said granular material thereinto, said forward wall extending inwardly from said tailgate frame, said brine tank assembly having an input and brine outlet port assembly;

a broadcasting assembly supported from said tailgate frame, having a feed input adjacent said transport mechanism outlet and drivable to effect the broadcasting of said granular treatment material;

a broadcasting motor coupled in driven relationship with said broadcasting assembly;

a brine pump assembly mounted upon said tailgate frame, having an input coupled in fluid flow relationship with said brine tank assembly brine outlet port assembly and having an output extending to said transport mechanism;

first and second latching pins coupled to and extending from said tailgate frame at locations for latching engagement with respective said first and second tailgate latches; and said brine tank assembly being configured with said tailgate frame to provide a tailgate center of gravity at a vertical plane extending through said first and second frame pivot positions when the tailgate frame is hung from said first and second frame pivot positions.

13. The vehicle of claim 12 in which said brine tank assembly forward wall extends slopingly inwardly and upwardly through said tailgate frame from said bottom wall.

14. The vehicle of claim 13 in which:

the forwardly facing surface of said forward wall of said brine tank assembly is oriented with respect to a plane defined by said bottom wall at an angle of about 56°; and the fluid volumetric capacity of said brine tank assembly is about 140 gallons.

15. The vehicle of claim 13 including a buffer plate pivotally mounted with said tailgate frame and movable between an orientation in adjacency with said brine tank assembly forward wall and an orientation covering said transport mechanism feed opening.

16. The vehicle of claim 13 including a bottom support assembly with a bottom transport floor connected to said tailgate frame and extending beneath said transport mechanism, a back wall extending upwardly from said bottom transport floor in rearward adjacency with said transport mechanism, and an elevated, rearwardly extending platform supportably engaging said brine tank assembly bottom wall.

17. The vehicle of claim 16 in which said transport mechanism feed opening is defined by said bottom transport floor and said brine tank assembly forward wall.

18. The vehicle of claim 12 in which said first and second tailgate pivot mechanisms comprise:

first and second pivot shafts fixed to and extending mutually outwardly from said tailgate frame widthwise extent; and first and second links, each having outer and medial apertures spaced apart to locate said outer aperture at said first and second frame pivot positions when said medial apertures are located at said first and second normal pivot positions;

said first and second pivot shafts are pivotally coupled with the said outer aperture of respective said first and second links; and including first and second connectors removably coupling said medial apertures of said first and second links with respective said first and second normal pivot mechanisms.

19. The vehicle of claim 18 in which:

said first and second links include inward apertures spaced inwardly from said medical apertures;

including first and second stabilizing brackets fixed to respective said rims and spaced inwardly from respective said first and second normal pivot mechanisms; and third and fourth connectors removably coupling said inward apertures of said first and second links.

20. The vehicle of claim 12 in which:

said transport mechanism is an auger having drivably rotatable said flights from a first flight to a last flight located adjacent said outlet; and said brine pump assembly output is located to express fluid brine into admixing association with said granular material in the vicinity of said last flight.

21. The vehicle of claim 13 in which said brine tank assembly is configured having a cross section corresponding with an inverted, truncated right triangle.

22. The vehicle of claim 12 including:

a venting assembly extending through said brine tank assembly top wall; and a metal shield coupled to said tailgate frame and extending over said venting assembly.

* * * * *